US008124945B2

(12) United States Patent
Sakai et al.

(10) Patent No.: US 8,124,945 B2
(45) Date of Patent: Feb. 28, 2012

(54) SCINTILLATOR PLATE

(75) Inventors: Mika Sakai, Hino (JP); Takehiko Shoji, Hachioji (JP)

(73) Assignee: Konica Minolta Medical & Graphic, Inc. (JP)

( * ) Notice: Subject to any disclaimer, the term of this patent is extended or adjusted under 35 U.S.C. 154(b) by 171 days.

(21) Appl. No.: 12/594,304

(22) PCT Filed: Apr. 3, 2008

(86) PCT No.: PCT/JP2008/056680
§ 371 (c)(1),
(2), (4) Date: Oct. 1, 2009

(87) PCT Pub. No.: WO2008/126758
PCT Pub. Date: Oct. 23, 2008

(65) Prior Publication Data

US 2010/0108912 A1 May 6, 2010

(30) Foreign Application Priority Data

Apr. 5, 2007 (JP) ..... 2007-099235

(51) Int. Cl.
*G21K 4/00* (2006.01)

(52) U.S. Cl. ..... 250/484.4

(58) Field of Classification Search ..... 250/484.4
See application file for complete search history.

(56) References Cited

U.S. PATENT DOCUMENTS

| | | | | |
|---|---|---|---|---|
| 4,803,366 | A * | 2/1989 | Vieux et al. | 250/486.1 |
| 6,996,209 | B2 * | 2/2006 | Marek | 378/98.8 |
| 7,361,901 | B1 * | 4/2008 | Gaysinskiy | 250/361 R |
| 2003/0042429 | A1 | 3/2003 | Isoda | |
| 2005/0258377 | A1 * | 11/2005 | Nakano et al. | 250/484.4 |
| 2008/0083877 | A1 * | 4/2008 | Nomura et al. | 250/370.11 |

FOREIGN PATENT DOCUMENTS

| | | | |
|---|---|---|---|
| DE | 10305338 | A1 | 8/2003 |
| EP | 0185534 | A2 | 6/1986 |
| EP | 1276117 | A2 | 1/2003 |
| JP | 61-245099 | A | 10/1986 |
| JP | 63-215987 | A | 9/1988 |
| JP | 7-21560 | B2 | 3/1995 |
| JP | 2003-28994 | A | 1/2003 |
| JP | 2003-232893 | A | 8/2003 |
| JP | 2006-225733 | A | 8/2006 |

OTHER PUBLICATIONS

International Search Report for International Application No. PCT/JP2008/056680 mailed Jun. 10, 2008 with English translation.

* cited by examiner

*Primary Examiner* — David Porta
*Assistant Examiner* — Hugh H Maupin
(74) *Attorney, Agent, or Firm* — Cantor Colburn LLP

(57) ABSTRACT

A scintillator plate which is excellent in sharpness and luminance is disclosed, comprising sequentially on a substrate a reflection layer and a scintillator layer containing cesium iodide and an activator and having a thickness of L, wherein the following requirement (1) is met:

$2 \leq B/A$ Requirement (1)

wherein A is an average activator concentration of the scintillator layer and B is an activator concentration in a region of the scintillator layer from the reflection layer side to the position of L/5.

7 Claims, 1 Drawing Sheet

SCINTILLATOR PLATE

FIELD OF THE INVENTION

The present invention relates to a scintillator plate for use in formation of a radiation image of the object.

TECHNICAL FIELD

There have been broadly employed radiographic images such as X-ray images for diagnosis of the conditions of patients on the wards. Specifically, radiographic images using a intensifying-screen/film system have achieved enhancement of speed and image quality over its long history and are still used on the scene of medical treatment as an imaging system having high reliability and superior cost performance in combination. However, these image data are so-called analog image data, in which free image processing or instantaneous image transfer cannot be realized.

Recently, there appeared digital system radiographic image detection apparatuses, as typified by a computed radiography (also denoted simply as CR) and a flat panel RADIATION detector (also denoted simply as FPD). In these apparatuses, digital radiographic images are obtained directly and can be displayed on an image display apparatus such as a cathode tube or liquid crystal panels, which renders it unnecessary to form images on photographic film. Accordingly, digital system radiographic image detection apparatuses have resulted in reduced necessities of image formation by a silver salt photographic system and leading to drastic improvement in convenience for diagnosis in hospitals or medical clinics.

The computed radiography (CR) as one of the digital technologies for radiographic imaging has been accepted mainly at medical sites. However, image sharpness is insufficient and spatial resolution is also insufficient, which have not yet reached the image quality level of the conventional screen/film system. Further, there appeared, as a digital X-ray imaging technology, an X-ray flat panel detector (FPD) using a thin film transistor (TFT), as described in, for example, the article "Amorphous Semiconductor Usher in Digital X-ray Imaging" described in Physics Today, November, 1997, page 24 and also in the article "Development of a High Resolution, Active Matrix, Flat-Panel Imager with Enhanced Fill Factor" described in SPIE, vol. 32, page 2 (1997).

The flat panel radiation detector (FPD) is featured in that the apparatus has become more compact than the CR and image quality at a relatively high dose is superior. Meanwhile, an photographing at a relatively low dose results in lowered S/N ratio due to electrical noises of TFT or a circuit itself and has not yet attained a sufficient image quality level.

To convert radiation to visible light is employed a scintillator panel made of an X-ray phosphor which is emissive for radiation. The use of a scintillator panel exhibiting enhanced emission efficiency is necessary for enhancement of the SN ratio in radiography at a relatively low dose.

Generally, the emission efficiency of a scintillator panel depends of the scintillator thickness and X-ray absorbance of the phosphor. A thicker phosphor layer causes more scattering of emission within the phosphor layer, leading to deteriorated sharpness. Accordingly, necessary sharpness for desired image quality level necessarily determines the layer thickness.

Specifically, cesium iodide (CsI) exhibits a relatively high conversion rate of from X-rays to visible light. Further, a columnar crystal structure of the phosphor can readily be formed through vapor deposition and its light-guiding effect inhibits scattering of emitted light within the crystal, enabling an increase of the phosphor layer thickness (as described in, for example, Patent document 1).

As is known in the art, an element such as thallium, sodium or rubidium, a so-called activator, was contained in cesium iodide to achieve enhanced emission efficiency. It was also attempted that a reflection plane was provided at the end of a scintillator which was placed far from the light receiving element to achieve enhanced transmission of light from the scintillator to the light receiving element (as described in, for example, Patent document 2).

Light which propagates within a crystal via the light-guiding effect is classified to a light heading from the base of the crystal to the top or a light heading from the top to the base. The light heading from the top to the base results in an increased scattering component when reflected by the substrate. Increased luminance results in an increased quantity of light transmitting within a crystal, leading to an increase of scattered light and resulting in problems such as a lowering of sharpness.

Patent document 1: JP 63-215987A
Patent document 2: JP 7-21560B

DISCLOSURE OF THE INVENTION

Problem to be Solved

It is an object of the present invention to provide a scintillator plate which is superior in sharpness and luminance.

Means to Solve the Problem

The object of the invention can be achieved by the following constitution.

1. A scintillator plate comprising sequentially on a substrate a reflection layer and a scintillator layer containing cesium iodide and an activator and having a thickness of L, wherein the following requirement (1) is met:

$$2 \leqq B/A \qquad \text{Requirement (1)}$$

wherein A is an average activator concentration of the scintillator layer and B is an activator concentration in a region of the scintillator layer from the reflection layer side to the position of L/5.

2. The scintillator plate as described in foregoing 1, wherein the scintillator layer is comprised of columnar crystals.

3. The scintillator plate as described in foregoing 1 or 2, wherein an average activator concentration is from 0.001 to 50 mol %, based on cesium iodide.

4. The scintillator plate as described in any of foregoing 1 to 3, wherein the activator is a thallium compound.

5. The scintillator plate as described in any of foregoing 1 to 4, wherein the columnar crystals are crystals formed on the substrate by a process of heating an evaporation source containing cesium iodide and a thallium compound to perform vapor deposition onto the substrate.

6. The scintillator plate as described in foregoing 4 or 5, wherein the thallium compound is thallium bromide, thallium chloride, thallium iodide or thallium fluoride.

7. The scintillator plate comprising on a substrate a reflection layer and a scintillator layer containing cesium iodide and an activator in the sequence set for the as described in any of foregoing 2 to 6, wherein the following requirement is met:

$$30 \geqq b/a \geqq 1.5$$

wherein "a" is an average equivalent circular diameter of the columnar crystals of the scintillator layer at the position of 10 μm from the substrate and "b" is an average equivalent circular diameter at the top of the columnar crystals.

Effect of the Invention

According to the present invention, there was provided a scintillator plate which was superior in sharpness and luminance.

DESCRIPTION OF THE DESIGNATION

Figure 1:
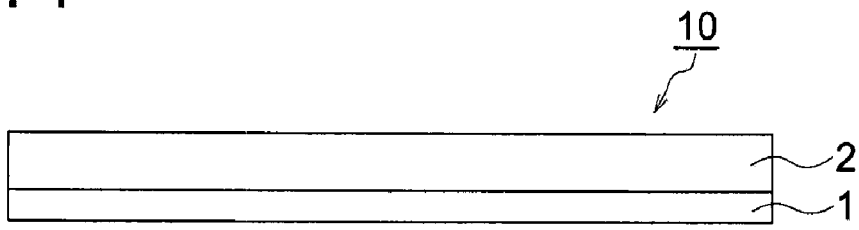
FIG. 1 shows a sectional view of an example of a scintillator plate of the present invention.

1: Substrate
2: Scintillator layer
10: Scintillator plate
20: Vapor deposition apparatus
21: Vacuum pump
22: Vacuum vessel
23: Resistance heating crucible
24: Rotation mechanism
25: Substrate holder

Preferred Embodiment of the Invention

In the following, there will be detailed the present invention.

The scintillator plate of the present invention comprises, on a substrate, a reflection layer and further thereon, a scintillator layer containing cesium iodide and an activator and having a thickness of L, featured in that the following requirement (1) is met:

$$2 \leqq B/A \qquad \text{Requirement (1)}$$

wherein A is an average activator concentration of the scintillator layer and B is an activator concentration within a range of from the reflection layer surface to a thickness of L/5. Further, the scintillator plate comprising on a substrate a reflection layer and a scintillator layer containing cesium iodide and an activator in that order, featured in that the following requirement is met:

$$30 \geqq b/a \geqq 1.5$$

wherein "a" is an average equivalent circular diameter of columnar crystals of the scintillator layer at the position of 10 μm from the substrate and "b" is an average equivalent circular diameter at the top of the columnar crystals.

The scintillator layer relating to the invention is one containing a phosphor (scintillator) emitting an electromagnetic wave (light) from an ultraviolet rays to infrared rays throughout visible light, and the layer comprises a vapor-deposited crystal containing cesium iodide and an activator.

Substrate

The substrate relating to the present invention is a plate or a film which is capable of supporting a scintillator layer and transmitting radiation such as X-rays to transmit at not less than 10% of the incident dose.

The substrate may be of various types of glass, polymeric materials and metals.

Examples thereof include a plate glass such as quartz, borosilicate glass or chemically reinforced glass; a ceramic substrate such as sapphire, silicon nitride or silicon carbide; a semiconductor substrate such as silicon, germanium, gallium arsine, gallium phosphorus or gallium nitrogen; polymeric film such as cellulose acetate film, polyester film, polyethylene terephthalate film, polyamide film, polyimide film, triacetate film, polycarbonate film or carbon fiber-reinforced resin sheet; and a metal sheet such as an aluminum sheet, iron sheet or copper sheet, or a metal sheet having a coverage layer of oxides of the foregoing metals.

The substrate is preferably a 50-500 μm thick, flexible polymeric film. The expression "flexible" refers to exhibiting an elastic modulus at 120° C. (E120) of 1000 to 6000 N/mm$^2$. Such a substrate is preferably a polymeric film comprising a polyimide or polyethylene naphthalate.

The elastic modulus is obtained from a slope of stress versus strain in the region which exhibits a linear relationship of strain and corresponding stress, represented by a marked line of a sample and obtained by using a tensile tester according to JIS C2318. This value is called Young's modulus. In the present invention, this Young's modulus represents an elastic modulus.

The substrate usable in the present invention preferably exhibits an elastic modulus at 120° C. (E120) of 1000 to 6000 N/mm$^2$, as described above, and more preferably from 1200 to 5000 N/mm$^2$.

Specifically, there are included polymeric films such as polyethylene naphthalate (E120=4100 N/mm$^2$), polyethylene terephthalate (E120=1500 N/mm$^2$), polybutylene naphthalate (E120=1600 N/mm$^2$), polycarbonate (E120=1700 N/mm$^2$) syndiotactic polystyrene (E120=2200 N/mm$^2$) and polyetherimide (E120=1900 N/mm$^2$).

These films may be used singly or in their combination, or may be laminated. A polymeric film comprising polyimide or polyethylene naphthalate is specifically preferred.

Reflection Layer

A reflection layer relating to the present invention is a layer capable of reflecting an electromagnetic wave of fluorescence which has been generated in a scintillator layer and radiantly propagates toward the substrate.

A metal thin-film is used for the reflection layer. Such a metal thin film is preferably one which is comprised of a material containing a substance selected from the group of Al, Ag, Cr, Cu, Ni, Ti, Mg, Rh, Pt and Au. A metal thin film may be formed of at least two layers, for example, an Au layer formed on a Cr layer. Of the foregoing, it is a preferred embodiment to employ a layer containing aluminum.

Scintillator Layer

A scintillator layer relating to the invention is one containing a radiative phosphor upon exposure to radiation and is formed of a vapor-deposited crystal containing cesium iodide and an activator.

Such an activator relating to the present invention refers to an element which is incorporated in the cesium iodide, thereby enhancing emission efficiency. Examples of an activator include a thallium compound, a sodium compound and a rubidium compound, of which the thallium compound is preferred. To allow such an activator to be incorporated in cesium iodide, for instance, an evaporation source containing cesium iodide and a thallium compound is heated to perform deposition onto the substrate described above.

The vapor-deposited crystal relating to the present invention is a crystal formed by heating an evaporation source including cesium iodide and an activator-containing compound, followed by vapor deposition onto the substrate.

In the present invention, an activator is preferably a thallium compound and examples of a thallium compound used for vapor deposition include thallium bromide, thallium chloride, thallium iodide and thallium fluoride.

An average activator concentration within the deposited crystals is preferably in the range of from 0.001 to 50 mol %, based on cesium iodide in terms of emission luminance, of which a range of from 0.1 to 20 mol % is more preferred.

Such a vapor-deposited crystals are preferably columnar crystals.

The effect of the present invention can be achieved when a scintillator layer satisfies the requirement 2 B/A in which A is the average activator concentration of the scintillator layer and B is the average activator concentration in a region of ⅕ of the total scintillator layer thickness on the substrate side, and preferably, $2 \leqq B/A \leqq 10$. B>10 causes disorder in crystallinity on the substrate side, resulting in a lowered independency of columnar crystals and making it difficult to form a 400 μm or more thick deposited layer. Further, even when such a ⅕ region of the scintillator layer from the substrate is constituted of two or more layers including a layer containing no Tl, the effect of the present invention can be achieved by meeting the above-described requirement. In the present invention, the Tl concentration can be determined by the procedure described below.

A columnar crystal is equally divided into five parts in the growth direction of the crystal and the thus divided parts were each measured with respect to activator concentration. The activator concentration is by an inductively coupled plasma atomic emission spectrometer (ICP-AES). This method is a technique in which light generated when a metal element or the like is excited in plasma is spectroscopically divided to perform qualitative analysis from the wavelength inherent to the individual element and qualitative analysis is derived from the emission intensity, whereby trace amounts of inorganic elements contained in an aqueous solution can be determined quantitatively or qualitatively.

Typically, the quantity of thallium is determined in such a manner that concentrated hydrochloric acid is added to the phosphor sample which was peeled from the substrate, thermally dried and is again dissolved by adding aqua regia with heating. The thus obtained solution was optimally diluted with super pure water and subjected to measurement.

Activator concentration is represented by a molar ratio (mol %) to cesium iodide.

An mean value of activator concentrations of the thus divided regions is defined as an average concentration A and of the regions divided into five parts, the average activator concentration of the region closest to the substrate is defined as an average concentration B. When A and B satisfy the relationship of $2 \leqq B/A$, yellow-coloring occurs in the crystal region closest to the substrate, whereby emitted light is absorbed in the yellow-colored portion of the crystal bottom. Accordingly, light heading toward the substrate surface is absorbed, whereby scattered components are reduced, achieving enhanced sharpness.

Examples of general methods for preparing a scintillator plate of such a structure include a technique in which evaporation sources differing in activator concentration are used in vapor deposition and the timing of deposition is delayed and a technique in which Tl and CsI are separately evaporated from separate evaporation sources.

In the present invention, it is preferred to satisfy the requirement of $30 \geqq b/a \geqq 1.5$, wherein "a" is the average equivalent circular diameter of columnar crystal of the scintillator layer at the position of 10 μm from the substrate and "b" is the average equivalent circular diameter at the top of the columnar crystals.

The equivalent circular diameter of a columnar crystal is measured in such a manner that a scintillator layer formed of columnar crystals is coated with an electrically conductive substance (e.g., platinum palladium, gold, carbon) and observed by a scanning electron microscope (SEM, e.g., S-800, produced by Hitachi Seisakusho Co., Ltd.), and the equivalent circular diameter of the individual columnar crystal is determined from the obtained image. The average equivalent circular diameter is obtained on an average of 30 columns. The average equivalent circular diameter at the top of the columnar crystals is determined by observation of the crystal surface formed at the time when completing deposition, and the average equivalent circular diameter at the position of 10 μm from the substrate is also determined by observation of the crystal surface obtained by shaving the crystal layer surface with a cutter to the position of 10 μm from the substrate. Herein, the equivalent circular diameter refers to the diameter of a circle circumscribing a section of the individual columnar crystal.

When an average equivalent circular diameter (a) of columnar crystals of the scintillator layer, at the position of 10 μm from the substrate and an average equivalent circular diameter (b) at the top of columnar crystals satisfy the requirement of $30 \geqq b/a \geqq 1.5$, the smaller crystal diameter on the substrate side results in enhanced independency of crystals and the larger crystal diameter at the top results in increased emitting sectional area, leading to enhanced luminance. Values of $30 < b/a$ result in reduced strength of the columnar crystals.

Preparation of a scintillator plate of such a structure can be achieved by any commonly known method, for example, in such a manner that inert gas, e.g., Ar gas is introduced in a relatively large amount at the initial stage of deposition and the amount of Ar gas is decreased toward the later stage.

Intermediate Layer

In the present invention, an intermediate layer may be provided between the reflection layer and the scintillator layer.

Examples of an intermediate layer include a layer containing a resin such as a polyester resin, a polyacrylic acid copolymer, a polyacrylamide, its derivatives or its partially hydrolyzed product; a vinyl polymer such as polyvinyl acetate, polyacrylamide or polyacrylic acid ester or its copolymer; a natural product such rosin or shellac and its derivatives.

Scintillator Plate

There will be described the scintillator plate of the present invention with reference to FIG. 1.

As shown in FIG. 1, a scintillator plate 10 for radiation, of the invention is provided with a phosphor layer 2 on a substrate 1. When the phosphor layer 2 is exposed to radiation, the phosphor layer 2 emits an electromagnetic wave at the wavelength of 300 to 800 nm, centered on visible light, upon absorption of incident radiation energy.

There will be described a method of forming the phosphor layer 2 on the substrate 1.

The phosphor layer 2 is formed by the process of vapor deposition, which is performed in the following manner. The substrate 1 is set inside a commonly known deposition apparatus and raw material for the phosphor layer 2 including prescribed additives is charged into a deposition source. Thereafter, the inside of the apparatus is evacuated to vacuum at 1.333 Pa to $1.33 \times 10^{-3}$ Pa, concurrently with introducing inert gas such as nitrogen from the entrance. Subsequently, at least one of raw materials of a phosphor is vaporized with heating by a method such as a resistance heating method or an electron beam method and deposited on the substrate 1 to form a phosphor layer (2) having a prescribed thickness. This deposition process may be repeated plural times to form the phosphor layer (2). For example, plural deposition sources of an identical constitution are prepared and when completing deposition of one deposition source, deposition of the next deposition source is started. These are repeated until reaching the desired layer thickness to form the phosphor layer (2).

Figure 2:
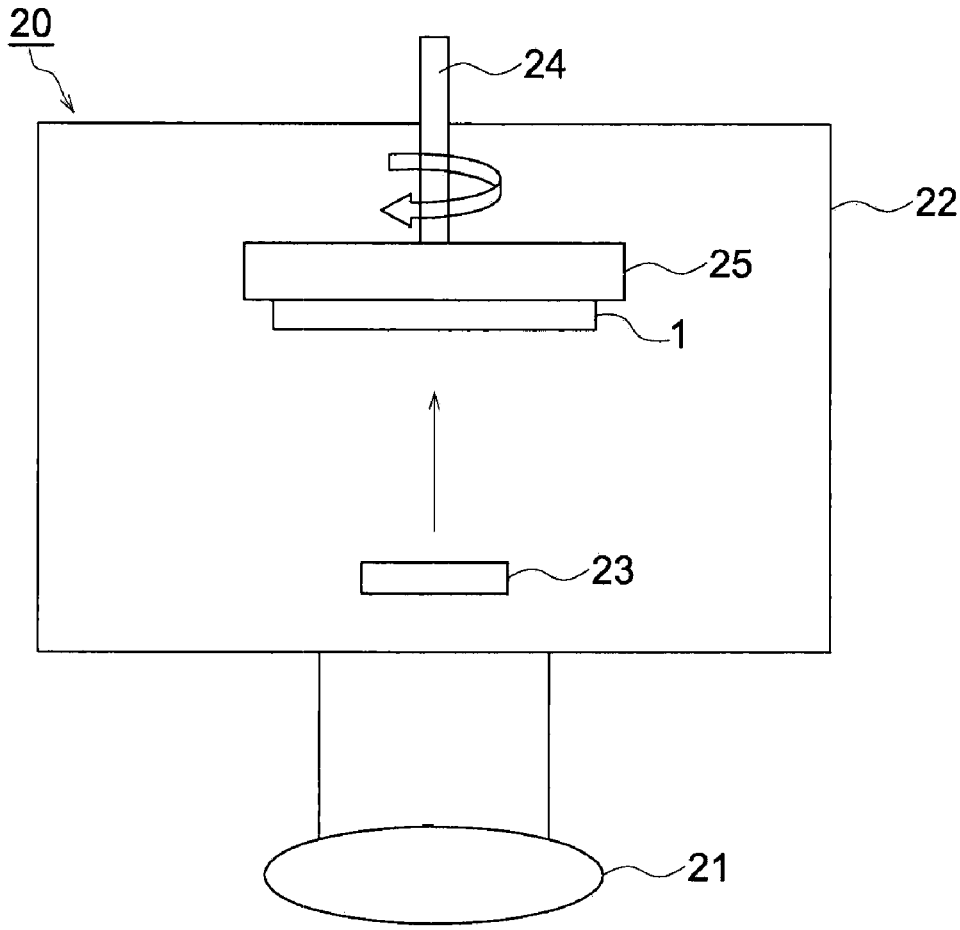
FIG. 2 illustrates a schematic structure of a vapor deposition apparatus related to the invention.

With reference to FIG. 2, there will be described a deposition apparatus 20, as one example of deposition apparatuses used when performing vapor deposition.

The deposition apparatus is provided with a vacuum pump 21 and a vacuum vessel 22 which is internally evacuated by operation of the vacuum pump 21. A resistance heating crucible 23 as a deposition source is provided in the inside of the vacuum vessel. On the upper side of the resistance heating crucible 23, a substrate (1) is provided via a substrate holder 25 which is pivotable through a rotation mechanism 24. A slit to control a vapor stream of a phosphor vaporized from the resistance heating crucible 23 is provided between the resistance heating crucible 23 and the substrate (1). When operating the deposition apparatus 20, the substrate 1 is used while placed on the substrate holder 25.

In the preparation method of forming a phosphor layer on the substrate by a process of vapor deposition, the requirement of $2 \leqq B/A$ can be achieved by evaporating a raw deposition material having a relatively high activator concentration at the initial deposition stage, wherein A is the average activator concentration of the scintillator layer and B is the average activator concentration in the region of ⅕ of the total scintillator layer thickness on the substrate side. Further, thickening a column diameter from the substrate side toward the top can be attained by introducing an inert gas such as Ar gas in a relatively large amount in the initial stage of deposition and decreasing the Ar gas amount in the later stage.

EXAMPLES

The present invention will be described with reference to examples but is by no means limited to these.

Example 1

Preparation of Substrate

A 0.5 mm thick aluminum sheet was cut to 10×10 cm to be used for a substrate.

Preparation of Scintillator Layer

There were prepared evaporation materials which were each composed of cesium iodide and thallium iodide (TlI), as the raw activator material, at a concentration of 2.4 mol % or 0.3 mol % of CsI. The prepared evaporation materials were each placed into separate resistance heating crucibles. The substrate was provided on a rotating substrate holder and the distance between the substrate and the evaporation source was adjusted to 400 mm.

Subsequently, the inside of the vapor deposition apparatus was evacuated and then, Ar gas was introduced thereto to control an evacuation degree to 0.1 Pa, thereafter, the temperature of the substrate was maintained at 200° C., while rotating the substrate at a rate of 10 rpm. Then, the resistance heating crucible, having a material of a higher Tl concentration was heated to allow a phosphor for a scintillator to be deposited. When the scintillator (phosphor layer) reached a thickness of 100 μm, evaporation of the resistance heating crucible having a material of a lower Tl concentration was started in turn. When the total layer thickness reached 500 μm, deposition was completed to obtain a scintillator plate.

Example 2

Preparation of Substrate

Preparation of the substrate was conducted in the same manner as Example 1.

Preparation of Scintillator Layer

Thallium iodide (TlI) as an raw activator material was mixed with cesium iodide (CsI). There were prepared evaporation materials which were each composed of cesium iodide and thallium iodide (TlI) at a concentration of 1.5 mol % or 0.3 mol % of cesium iodide. The prepared evaporation materials were each placed into separate resistance heating crucibles. The substrate was provided on a rotating substrate holder and the distance between the substrate and the evaporation source was adjusted to 400 mm.

Subsequently, the inside of a vapor deposition apparatus was evacuated and then, Ar gas was introduced thereto to control an evacuation degree to 0.1 Pa, thereafter, the temperature of the substrate was maintained at 200° C., while rotating the substrate at a rate of 10 rpm. Then, the resistance heating crucible having a material of a higher Tl concentration was heated to allow the phosphor for a scintillator to be deposited. When the scintillator (phosphor layer) reached a thickness of 100 μm, evaporation of a resistance heating crucible having a material of a lower Tl concentration was started in turn. When the total layer thickness reached 500 μm, deposition was completed to obtain a scintillator plate.

Example 3

Preparation of Substrate

Preparation of the substrate was conducted in the same manner as Example 1.

Preparation of Scintillator Layer

Thallium iodide (TlI) as an raw activator material was mixed with cesium iodide (CsI). There were prepared evaporation materials which were each composed of cesium iodide and thallium iodide (TlI) at a concentration of 3.1 mol % or 0.3 mol % of cesium iodide. The prepared evaporation materials were each placed into separate resistance heating crucibles. The substrate was provided on a rotating substrate holder and the distance between the substrate and the evaporation source was adjusted to 400 mm.

Subsequently, the inside of a vapor deposition apparatus was evacuated and then, Ar gas was introduced thereto to control an evacuation degree to 0.1 Pa, thereafter, the temperature of the substrate was maintained at 200° C., while rotating the substrate at a rate of 10 rpm. Then, the resistance heating crucible having a material of a higher Tl concentration was heated to allow a phosphor for a scintillator to be deposited. When the scintillator (phosphor layer) reached a thickness of 100 μm, evaporation of the resistance heating crucible having a material of a lower Tl concentration was started in turn. When the total layer thickness reached 500 μm, deposition was completed to obtain a scintillator plate.

Example 4

Preparation of Substrate

Preparation of the substrate was conducted in the same manner as Example 1.

Preparation of Scintillator Layer

Evaporation materials were prepared in the same manner as in Example 1.

Subsequently, the inside of a vapor deposition apparatus was evacuated and then, Ar gas was introduced thereto to control an evacuation degree to 0.1 Pa, thereafter, the temperature of the substrate was maintained at 200° C., while rotating the substrate at a rate of 10 rpm. Then, the resistance heating crucible having a material of a higher Tl concentration was heated to allow the phosphor for a scintillator to be deposited. When the scintillator (phosphor layer) reached a thickness of 100 μm, evaporation of a resistance heating crucible having a material of a lower Tl concentration was started in turn. When the total layer thickness reached 400 μm with reducing the amount of Ar gas introduced at the start of deposition, deposition was completed to obtain a scintillator plate. The amount of Ar gas introduced at the completion of deposition was ⅓ of that of the start of deposition.

Example 5

Preparation of Substrate

Preparation of the substrate was conducted in the same manner as Example 1.

Preparation of Scintillator Layer

Subsequently, the inside of a vapor deposition apparatus was evacuated and then, Ar gas was introduced thereto to control an evacuation degree to 0.1 Pa, thereafter, the temperature of the substrate was maintained at 200° C., while rotating the substrate at a rate of 10 rpm. Then, the resistance heating crucible having a material of a higher Tl concentration was heated to allow a phosphor for a scintillator to be deposited. When the scintillator (phosphor layer) reached a thickness of 100 μm, evaporation of a resistance heating crucible having a material of a lower Tl concentration was started in turn. When the total layer thickness reached 400 μm with reducing the amount of Ar gas introduced at the start of deposition, deposition was completed to obtain a scintillator plate. The amount of Ar gas introduced at the completion of deposition was 1/10 of that of the start of deposition.

Comparative Example 1

Preparation of Substrate

Preparation of the substrate was conducted in the same manner as Example 1.

Preparation of Scintillator Layer

Thallium iodide (TlI) as a raw activator material was mixed with cesium iodide (CsI). There were prepared evaporation materials which were each composed of cesium iodide and thallium iodide (TlI) at a concentration of 0.6 mol % or 0.3 mol % of cesium iodide. The prepared evaporation materials were each placed into separate resistance heating crucibles. The substrate was placed on a rotating substrate holder and the distance between the substrate and the evaporation source was adjusted to 400 mm.

Subsequently, the inside of the vapor deposition apparatus was evacuated and then, Ar gas was introduced thereto to control the evacuation degree to 0.1 Pa, thereafter, the temperature of the substrate was maintained at 200° C., while rotating the substrate at a rate of 10 rpm. Then, the resistance heating crucible having a material of a higher Tl concentration was heated to allow a phosphor for a scintillator to be deposited. When the scintillator (phosphor layer) reached a thickness of 100 μm, evaporation of a resistance heating crucible having a material of a lower Tl concentration was started in turn. When the total layer thickness reached 500 μm, deposition was completed to obtain a scintillator plate.

Comparative Example 2

Preparation of Substrate

Preparation of the substrate was conducted in the same manner as Example 1.

Preparation of Scintillator Layer

Thallium iodide (TlI) as a raw activator material was mixed with cesium iodide (CsI). There were prepared AN evaporation material which was composed of cesium iodide and thallium iodide (TlI) at a concentration of 0.3 mol % of cesium iodide. The prepared evaporation material was placed into resistance heating crucibles. The substrate was provided on a rotating substrate holder and the distance between the substrate and the evaporation source was adjusted to 400 mm.

Subsequently, the inside of the vapor deposition apparatus was evacuated and then, Ar gas was introduced thereto to control the evacuation degree to 0.1 Pa, thereafter, the temperature of the substrate was maintained at 200° C., while rotating the substrate at a rate of 10 rpm. Then, the resistance heating crucible having an evaporation material was heated to allow a phosphor for a scintillator to be deposited. When the total layer thickness reached 500 μm, deposition was completed to obtain a scintillator plate.

Comparative Example 3

Preparation of Substrate

Preparation of the substrate was conducted in the same manner as Example 1.

Preparation of Scintillator Layer

Evaporation materials were prepared in the same manner as in Example 1.

Subsequently, the inside of a vapor deposition apparatus was evacuated and then, Ar gas was introduced thereto to control an evacuation degree to 0.1 Pa, thereafter, the temperature of the substrate was maintained at 200° C., while rotating the substrate at a rate of 10 rpm. Then, the resistance heating crucible having a material of a higher Tl concentration was heated to allow a phosphor for a scintillator to be deposited. When the scintillator (phosphor layer) reached a thickness of 100 μm, evaporation of a resistance heating crucible having a material of a lower Tl concentration was started in turn. When the total layer thickness reached 400 μm with reducing the amount of Ar gas introduced at the start of deposition, deposition was completed to obtain a scintillator plate. The amount of Ar gas introduced at the completion of deposition was 9.5/10 of that of the start of deposition.

Comparative Example 4

Preparation of Substrate

Preparation of the substrate was conducted in the same manner as Example 1.

Preparation of Scintillator Layer

Evaporation materials were prepared in the same manner as in Example 1.

Subsequently, the inside of a vapor deposition apparatus was evacuated and then, Ar gas was introduced thereto to control an evacuation degree to 0.1 Pa, thereafter, the temperature of the substrate was maintained at 200° C., while rotating the substrate at a rate of 10 rpm. Then, the resistance heating crucible having a material of a higher Tl concentration was heated to allow a phosphor for a scintillator to be deposited. When the scintillator (phosphor layer) reached a thickness of 100 μm, evaporation of a resistance heating crucible having a material of a lower Tl concentration was started in turn. When the total layer thickness reached 400 μm with reducing the amount of Ar gas introduced at the start of deposition, deposition was completed to obtain a scintillator plate. The amount of Ar gas introduced at the completion of deposition was 13/10 of that of the start of deposition.

Samples prepared in Examples 1, 2, 3, 4 and 5, and Comparative Examples 1, 2, 3 and 4 were each measured with respect to activator concentration and evaluated with respect to sharpness and luminance, as below.

Measurement of Activator Concentration

The obtained scintillator layer of each sample was divided along the crystal growth direction into five equal parts and the thus divided parts were individually measured with respect to activator concentration.

The activator concentration was measured in an inductively coupled plasma atomic emission spectrometer (ICP-AES), SPS-4000, produced by Seiko Denshi Kogyo. The quantity of Tl was determined in such a manner that concentrated hydrochloric acid was added to a phosphor sample, thermally dried and was again dissolved by adding aqua regia with heating, and the thus obtained solution was optimally diluted with super pure water and subjected to measurement. Activator concentration was represented by mol %, based on cesium iodide. An average activator concentration of five-divided parts and an average activator concentration of the region closest to the substrate of the regions divided into five equal parts are shown in Table 1.

Evaluation of Sharpness

The obtained scintillator plates were each mounted on Pax Scan 2520 (FPD produced by Varian Co.) and evaluated with respect to sharpness in accordance with the procedure, as below.

X-rays at a tube voltage 80 kVp were exposed onto the radiation-incident surface (the side on which no phosphor layer was formed) of each sample through a lead MTF chart, and the image data were detected and recorded onto a hard disk. Then, the data recorded on the hard disk was analyzed via a computer, and the modulation transfer function MTF (MTF values in % of a spatial frequency of 1 cycle/mm) of the X-ray image recorded on the foregoing hard disk was calculated as a measure of sharpness. The results thereof are shown in Table 1. In Table 1, values indicating sharpness are represented by a relative value, based on the sharpness of Example 1 being 100.

Evaluation of Luminance

Each sample was exposed to X-rays at a tube voltage 80 kVp from the backside (having no scintillator phosphor layer) of each sample. The instantaneous emission was extracted through an optical fiber and the light-emitting amount was measured by a photodiode (S2281, produced by Hamamatsu Photonics Co.). The obtained value was represented as emission luminance (sensitivity), provided that the emission luminance shown in Table 1 was represented by a relative value, based on the emission luminance of the sample of Example 3 being 1.0.

TABLE 1

| | Concentration at ⅕ B*1 (mol %) | Average Concentration A (mol %) | B/A | MTF | Remark |
|---|---|---|---|---|---|
| Example 1 | 1.3 | 0.5 | 2.6 | 100 | Inv. |
| Example 2 | 1.1 | 0.5 | 2.2 | 94 | Inv. |
| Example 3 | 1.6 | 0.5 | 3.2 | 115 | Inv. |
| Comparative Example 1 | 0.9 | 0.5 | 1.8 | 58 | Comp. |
| Comparative Example 2 | 0.5 | 0.5 | 1 | 40 | Comp. |

*1average activator concentration of the ⅕ region of the total layer thickness on the substrate side

TABLE 2

| | Average Equivalent Circular Diameter a*1 (μm) | Average Equivalent Circular Diameter b*2 (μm) | b/a | Luminance | Remark |
|---|---|---|---|---|---|
| Example 4 | 2 | 5 | 2.5 | 1 | Inv. |
| Example 5 | 1 | 11 | 11.0 | 0.99 | Inv. |
| Comparative Example 3 | 2 | 1.8 | 0.9 | 0.50 | Comp. |
| Comparative Example 4 | 2 | 2.2 | 1.1 | 0.63 | Comp. |

*1Average equivalent circular diameter of columnar crystal at the bottom of 10 μm from the substrate

*2Average equivalent circular diameter of columnar crystal at the top of the columnar crystal From Table 1, it was proved that scintillator plates according to the present invention were superior in sharpness. From Table 2, it was also proved that scintillator plates according to the present invention exhibited enhanced luminance.

What is claimed is:

1. A scintillator plate comprising sequentially on a substrate a reflection layer and a scintillator layer containing cesium iodide and an activator and having a thickness of L, wherein the following requirement (1) is met:

$$2 \leqq B/A \qquad \text{Requirement (1)}$$

wherein A is an average activator concentration of the scintillator layer and B is an activator concentration in a region of the scintillator layer from the reflection layer side to a position of L/5.

2. The scintillator plate as claimed in claim 1, wherein the scintillator layer is comprised of columnar crystals.

3. The scintillator plate as claimed in claim 1, wherein an average activator concentration is from 0.001 to 50 mol %, based on cesium iodide.

4. The scintillator plate as claimed in claim 1, wherein the activator is a thallium compound.

5. The scintillator plate as claimed in claim 1, wherein the columnar crystals are crystals formed on the substrate by a process of heating an evaporation source containing cesium iodide and a thallium compound to perform vapor deposition onto the substrate.

6. The scintillator plate as claimed in claim 4, wherein the thallium compound is thallium bromide, thallium chloride, thallium iodide or thallium fluoride.

7. The scintillator plate comprising on a substrate a reflection layer and a scintillator layer containing cesium iodide and an activator in the sequence set for the as claimed in claim 2, wherein the following requirement is met:

$$30 \geqq b/a \geqq 1.5$$

wherein "a" is an average equivalent circular diameter of the columnar crystals of the scintillator layer at the position of 10 μm from the substrate and "b" is an average equivalent circular diameter at the top of the columnar crystals.

* * * * *